US005791905A

United States Patent [19]

Larson, Jr.

[11] Patent Number: 5,791,905

[45] Date of Patent: Aug. 11, 1998

[54] WORKOUT SCHEDULING DEVICE

[76] Inventor: Raymond T. Larson, Jr., 120 Brookbridge Rd., Trout Valley, Ill. 60013

[21] Appl. No.: 900,504

[22] Filed: Jul. 25, 1997

[51] Int. Cl.[6] ..... G09B 1/00; G09B 19/00

[52] U.S. Cl. ..... 434/247; 434/78; 434/106; 434/206

[58] Field of Search ..... 434/206, 247, 434/127, 78, 106

[56] References Cited

U.S. PATENT DOCUMENTS

| | | | |
|---|---|---|---|
| 2,420,762 | 5/1947 | Torrence | 434/127 |
| 2,518,664 | 8/1950 | Chern | 434/106 |
| 2,956,358 | 10/1960 | Pennington | 434/127 |
| 3,277,591 | 10/1966 | Rutkofsky | 434/78 |
| 3,992,787 | 11/1976 | Lynch | 434/106 |
| 4,189,853 | 2/1980 | Provenzano | 434/106 |
| 4,472,144 | 9/1984 | Mantley | 434/106 |
| 4,711,632 | 12/1987 | Detrick | 434/106 |
| 5,640,774 | 6/1997 | Goldman | 434/206 |

*Primary Examiner*—Paul J. Hirsch
*Attorney, Agent, or Firm*—Ronald E. Smith

[57] ABSTRACT

A device for recording a series of exercises to be followed over a period of days and for indicating the order in which the exercises are to be performed on a given day. When the exercises are recorded in pencil, they may be erased and rewritten when the exercise regimen is changed by the exerciser. The device includes three flat, circular plates that are rotatable independently of one another about a common pivot point. A plurality of radially extending lines are disposed on a base plate and one exercise is written on each line. Exercises to be performed in one day are grouped together on contiguous radial lines. An intermediate plate has a window formed in it that exposes to view a group of the radial lines when the window is in registration with the group, and a pointer plate includes a pointer that points at an exercise written on a particular line of the group that is exposed to view. The pointer is indexed to the next contiguous line after the performance of each exercise and the intermediate plate is indexed to expose the next group of exercises at a time selected by the exerciser.

11 Claims, 3 Drawing Sheets

WORKOUT SCHEDULING DEVICE

BACKGROUND OF THE INVENTION

1. Field of the Invention

This invention relates, generally, to devices having utility in connection with a physical exercise program. More particularly, it relates to a device that frees a person following such a program from the need to remember details such as specific exercises, the order thereof, the number of repetitions, the time duration of the exercise, and the like.

2. Description of the Prior Art

Most people who try to follow an exercise regimen carry the details of the regimen in their heads. For example, an exerciser might decide to jog three miles every Monday, Wednesday, and Friday, and to do a certain number of differing calisthenics in a preselected order on Tuesdays, Thursdays, and Saturdays.

This approach to following an exercise regimen has numerous shortcomings. First of all, it is very easy to forget the details of a regimen of twenty pushups, forty situps, bench pressing one hundred pounds ten times, ten pullups, forty squat thrusts, pressing one hundred pounds ten times, curling one hundred fifty pounds ten times, one hundred side straddle hops/jumping jacks, and so on. This is especially true because the exerciser will want to increase the number of reps as his or her muscles become better developed. The exerciser will also want to vary the routine by doing pullups last, a weight-lifting exercise first, and so on. When scrambling the order of the exercises, it is very easy to omit at least one. Moreover, the exerciser will want to perform different exercises from time to time, substituting a new exercise for an old one; this makes it even more difficult to remember the regimen.

One solution to the problem that is used by some exercisers is to simply write down their routines on sheets of paper. However, papers are easy to lose, especially if one sheet is used for Monday's routine, another for the next exercise day, and so on. Moreover, a sheet of paper is not easy to post on an exercise device, such as a Nautilus® exercise machine, for easy reference. The exerciser therefore resorts to folding the paper and keeping it in a pocket. The paper must be removed from the pocket, unfolded, read, re-folded and reintroduced into the pocket at the completion of each exercise. This becomes burdensom and leads to exercisers returning to keeping the program in their heads again.

A small percentage of highly disciplined exercisers will carry their exercise schedule with them in a booklet. Although perhaps more convenient than a sheet of paper, a booklet cannot easily be detachably secured to an exercise machine so it must still be stored in a pocket, removed therefrom for consultation, returned to the pocket, etc., just like a sheet of paper.

Moreover, most exercisers wear sweatpants or similar garments when exercising, and such garments typically have no pockets. Thus, for most people, the option of carrying a loose sheet of paper or a booklet with them is simply not available.

What is needed, then, is a convenient, easy-to-use device that remembers exercise routines so that the exerciser need not. The ideal device would be portable, would be releasably attachable to exercise equipment, and would enable the exerciser to change the exercise regimen at will. Moreover, it would store enough data to cover an extended period of exercise, not just for a single day. The device should also be light-in-weight, compact in size, and substantially unbendable so that it can be carried in a carrying case with exercise clothing and the like.

However, in view of the art considered as a whole at the time the present invention was made, it was not obvious to those of ordinary skill in this art how the needed improvements could be provided.

SUMMARY OF THE INVENTION

The longstanding but heretofore unfulfilled need for an apparatus that overcomes the limitations of the prior art is now met by a new, useful, and nonobvious device for recording exercise regimens that includes a base plate having a flat construction and a round configuration, an intermediate plate having a flat construction and a round configuration, and a pointer plate having a flat construction and a generally round configuration.

The intermediate plate is disposed in sandwiched relation to the base plate and the pointer plate. A pivot means, such as a grommet, independently and rotatably connects the base plate, intermediate plate, and pointer plate in concentric relation to one another. A plurality of circumferentially spaced apart radial lines is disposed upon a first side of the base plate. Indicia means are provided for identifying preselected groups of the radial lines, and each radial line in a preselected group is contiguous to at least one other radial line in the preselected group.

A window means is formed in the intermediate plate, said window means being an opening formed in the intermediate plate which opening is bordered by first and second radially disposed edges that define a predetermined angle therebetween so that a preselected group of the radial lines are exposed to view when the window means is in registration therewith.

The pointer plate includes a radially extending protrusion that points at a preselected space between the radial lines when the pointer plate is rotated about the pivot means.

The base plate shares a common diameter with the intermediate plate, and the pointer plate has a predetermined diameter less than the common diameter of the base and intermediate plates. The predetermined diameter of the pointer plate is sufficiently small to maintain exposure to view of all radial lines framed by the window means.

Each group of radial lines is also color coded for convenience, and the beginning and ending of each group is denoted by small circumferentially-extending double-headed arrows. The color code is preferably provided on the radially outermost circumference of the base plate.

A circular line is disposed upon the base plate, radially inwardly of the color-coded area on the outermost perimeter of the base plate, so that information may be written in a space defined by a contiguous pair of radial lines, a segment of the circular line, and said color-coded area.

The novel device further includes a magnet means secured to a second side of the base plate to facilitate releasable attachment of the device to a ferrous support surface such as commonly found on exercise machines.

The exerciser uses the novel device by writing a series of exercises on the radial lines, one exercise per radial line, rotating the intermediate plate until the window means is aligned with a first preselected group of radial lines, then rotating the pointer plate until the pointer means indicates a preselected exercise written on a preselected radial line adjacent a first edge of the edges defined by the window means, performing the exercise written thereon, indexing the pointer plate until the pointer means indicates a next exercise written on a contiguous radial line in the preselected group, performing an exercise written on said contiguous radial line, and repeating those steps until the pointer means indicates a final exercise written on a radial line adjacent a second edge of the edges defined by the window means.

On the next exercise day (most exercisers do their workouts on every other day), the exerciser rotates the intermediate plate so that the window means enters into registration with a second preselected group of radial lines, and performs the exercises written thereon at a preselected time, in sequential fashion; the pointer means helps the exerciser keep track of the order of exercises within a group. This process is continuously repeated for as long as an exercise program is followed.

It is a primary object of this invention to free exercisers from having to remember long exercise schedules.

Another object is to provide a convenient device that records lengthy exercise schedules to accomplish the preceding object.

Another object is to provide such a device in a portable, easy-to-use structure that is releasably attachable to exercise machines yet which may be carried easily in an exercise bag.

Still another object is to provide a device that enables an exerciser to easily change the schedule of exercises for any given day.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
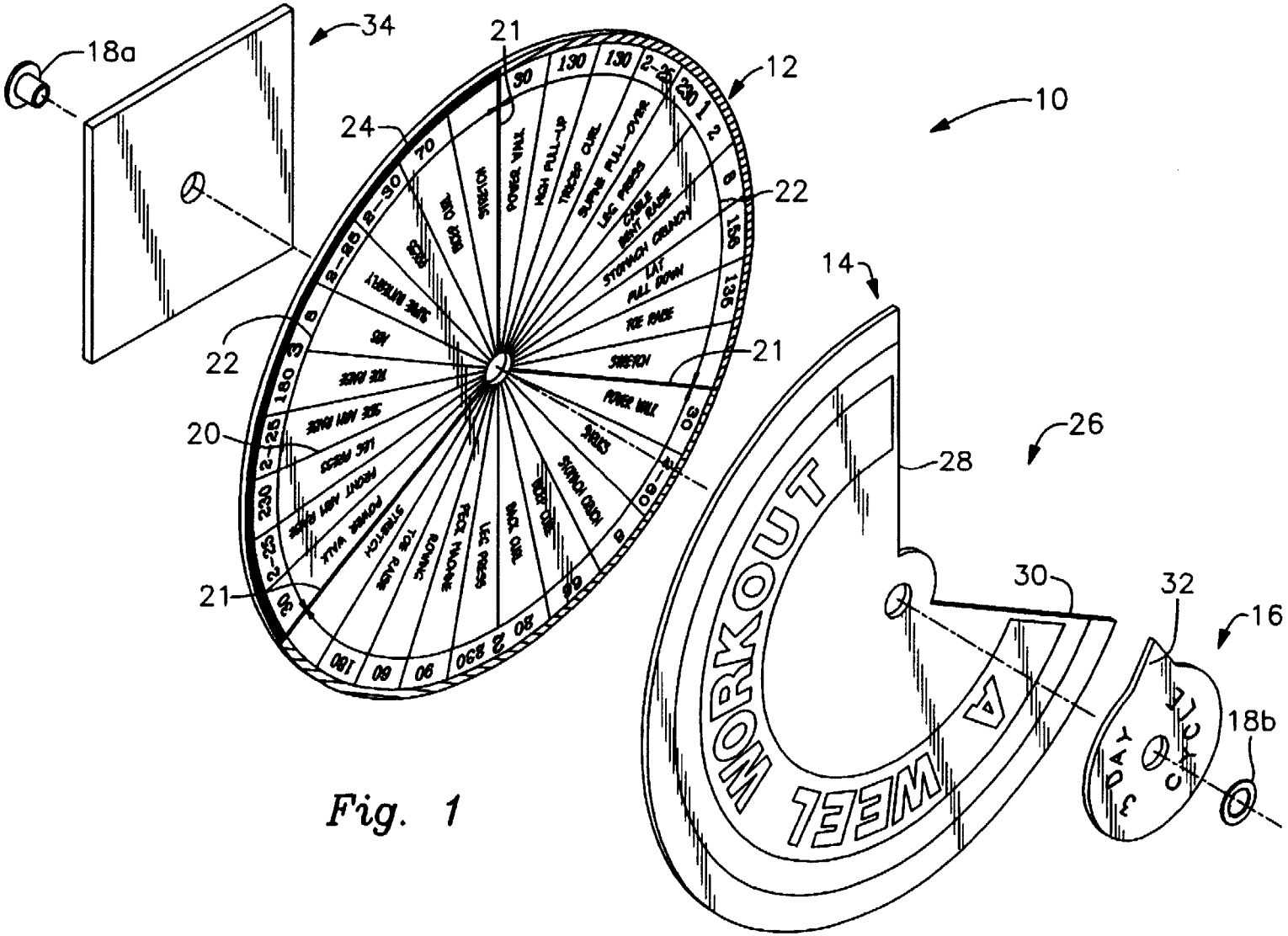
FIG. 1 is an exploded perspective view of the novel device.

Referring now to FIG. 1, it will there be seen that an exemplary embodiment of the invention is denoted as a whole by the reference numeral 10.

Embodiment 10, to be known commercially under the trademark "A Weel Workout," includes a circular base plate 12, an intermediate window-defining plate 14, and a pointer plate 16; plate 14 is sandwiched between plates 12 and 16. The three plates are independently rotatably mounted with respect to one another about a pivot means which preferably takes the form of a grommet 18 having a base **18*a* and a cap 18*b*. Grommet 18 extends through apertures formed in each plate 12, 14, and 16 at their respective centers so that all three of said parts are mounted concentrically with respect to one another and so that all three of said parts are rotatable about a common axis of rotation (depicted in FIG. 1** as a center line) independently of each other.

A plurality of radial lines, collectively denoted 20, are imprinted upon a first side of base plate 12. A circular line 22 is also imprinted thereupon, radially inwardly of the outermost periphery 24 of said base plate; note that a thin color-coded area is provided at the outermost edge of said base plate, radially outwardly of said circular line 22.

In the depicted embodiment, radial lines 20 are grouped into three groups, denoted 1, 2, and 3; it should be understood, however, that different groupings are within the scope of this invention. The groups may be identified or differentiated from one another by any physical means, including the above-mentioned color-coding which is depicted in FIGS. 1–4. Moreover, the radial lines at the boundaries, i.e, at the beginning and end of each group of radial lines, are printed on said base plate in a thicker line than are standard radial lines 20 to further delineate the groups from one another; said thicker lines are denoted 21. A plurality of pairs of small arrows, unnumbered to avoid cluttering the drawing, are provided at the opposite ends of each circular line 22 segment passing through a group to further indicate the boundaries of each group, i.e., each pair of arrows point in opposite directions with respect to each other and each arrow abuts a thickened radial line 21.

Intermediate plate 14 has a diameter common to that of base plate 12 and overlies said base plate. A window 26 is formed in said intermediate plate, said window being an opening formed in said intermediate plate that is bordered by first and second radially disposed edges 28, 30 that define a predetermined angle therebetween that is equal to the respective circumferential extents of the groupings 1, 2, and 3. For example, if there were four groupings 1, 2, 3, and 4, the predetermined angle between edges 28 and 30 would be ninety degrees. In the depicted embodiment, having three groupings, the angle between window edges 28, 30 is one hundred twenty degrees.

Third plate 16 is smaller in diameter than the base and intermediate plates; significantly, it includes a pointer means 32.

A flat, centrally apertured magnet means 34 is mounted in underlying relation to base plate 12 and is secured thereto by grommet 18, it being understood that said grommet holds said magnet means together with said base plate, intermediate plate, and pointer plate. Magnet means 34 facilitates releasable attachment of device 10 to a ferrous surface such as found on many exercise machines. Advantageously, device 10 may also be releasably mounted on a refrigerator door as well, to serve as a constant reminder to the exerciser.

To use novel device 10, the exerciser writes down each exercise to be performed on a given day, in a preferred order, on the radial lines 20 (including radial line 21 as well) within the group of lines denoted 1. Additional information about each exercise may be placed on the circular line 22, i.e., in the space radially outwardly of said circular line and radially inwardly of the color-coded area. For example, where the first exercise of the day is "power walk," the entry "30 minutes" may be entered on the associated circular line or anywhere in said space between said circular line and the color-coded area. All of the exercises to be performed during the next exercise session are then entered in the same fashion for the radial lines grouped under the numbers 2 and 3. The numbers 2 and 3 might represent the second and third days following the first day, or they may represent the third and fifth days, and so on, at the option of the exerciser. Since most people who follow an exercise regimen prefer to exercise every other day, the depicted example would represent a three day cycle that would be repeated every six days.

Figure 2:
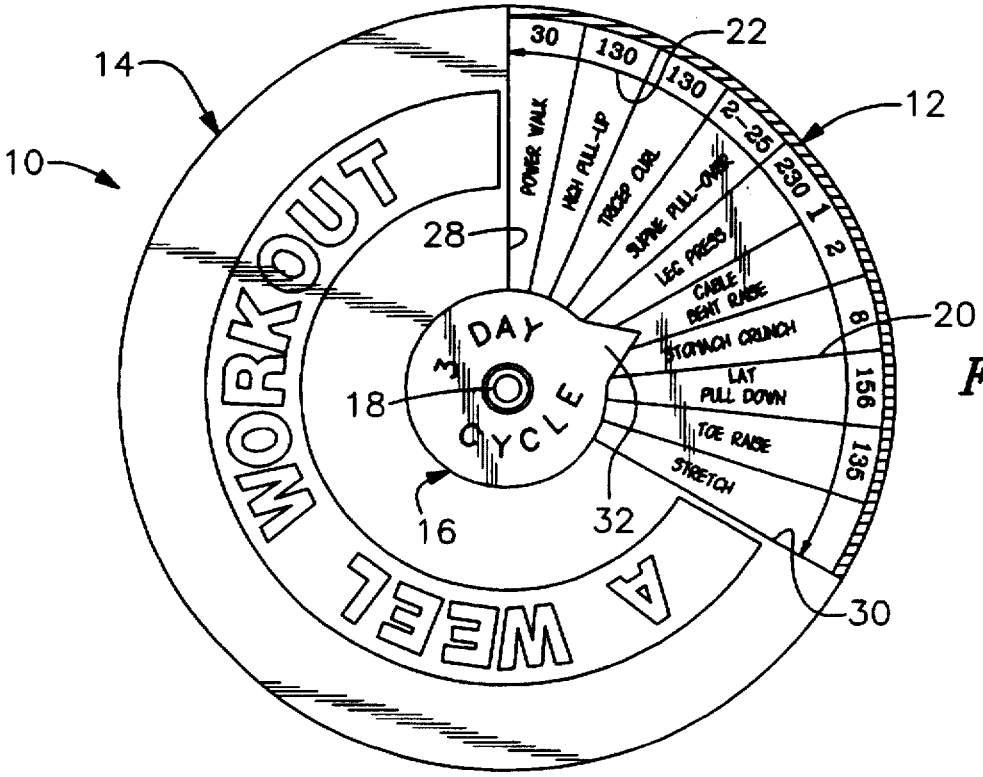
FIG. 2 is an elevational view depicting the device in its assembled configuration with the intermediate plate in a first position of its operable positions and with the pointer plate in one of its operable positions.

More particularly, after all of the exercises to be performed during the cycle of this example have been written down on the appropriate radial lines, the exerciser releasably secures device 10 to a suitable magnetic surface and rotates the window formed in intermediate plate 14 until said window frames all of the radial lines of group one (see FIG. 2). Pointer plate 16 is then rotated about pivot means 18 until pointer means 32 is directed toward the first exercise in group one, and the exerciser performs the exercise. In this example, the first exercise is a thirty minute power walk. (The pointer means, however, is pointing at the sixth exercise of day one, just for illustration purposes). The pointer means is then rotated so that it points to the next exercise of the sequence, and the exerciser follows that exercise. This process continues until all exercises in group one have been performed.

If desired, the exerciser can initially rotate pointer means 32 to the last item of exercise and work through the regimen in a backwards order.

Figure 3:
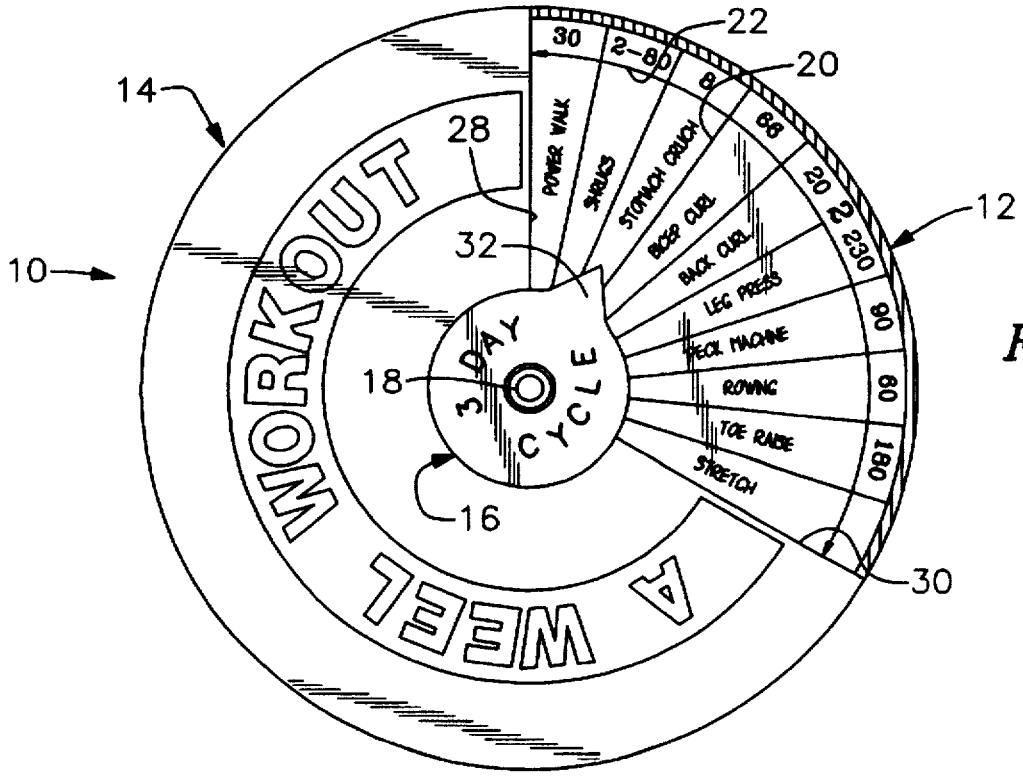
FIG. 3 is an elevational view depicting the device in its assembled configuration with the intermediate plate in a second position of its operable positions and with the pointer plate in one of its operable positions.
Figure 4:
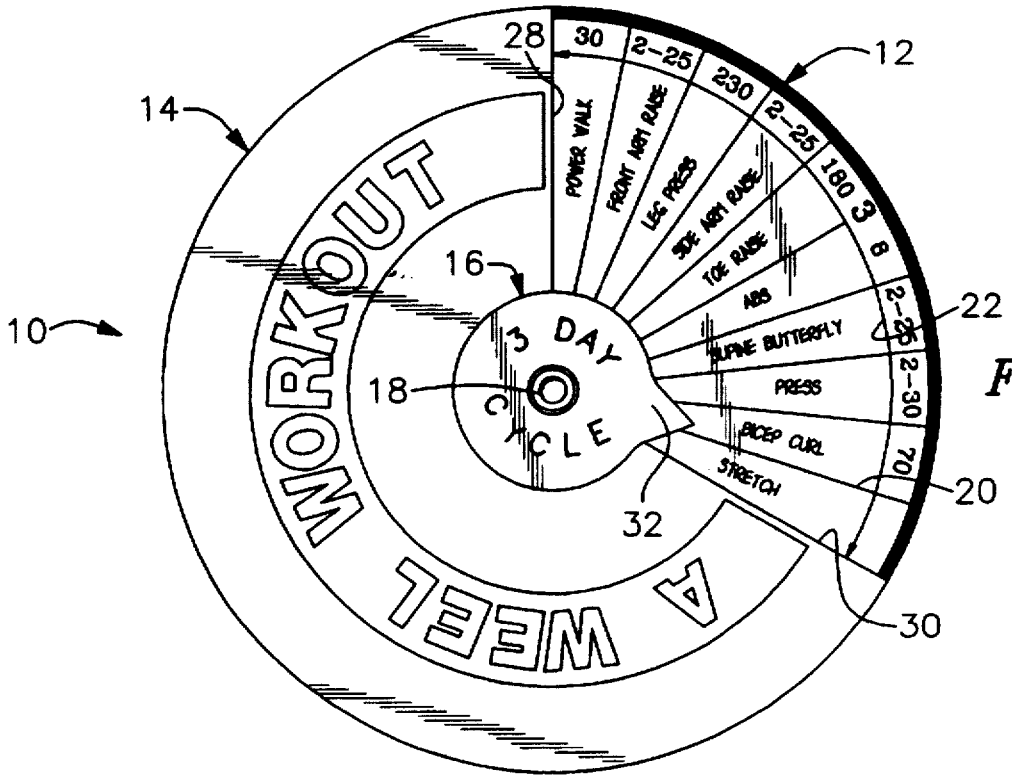
FIG. 4 is an elevational view depicting the device in its assembled configuration with the intermediate plate in a third position of its operable positions and with the pointer plate in one of its operable positions.

At the completion of the day's exercise program, or at the beginning of the next exercise day, intermediate plate 14 is rotated about pivot means 18 until window 26 frames the radial lines grouped together as group 2, as depicted in FIG. 3, and the above-described process is followed during the next exercise session. The same procedure is followed on the day of the third exercise regimen, as depicted in FIG. 4, and the cycle then returns to the exercises of group 1.

Figure 5:
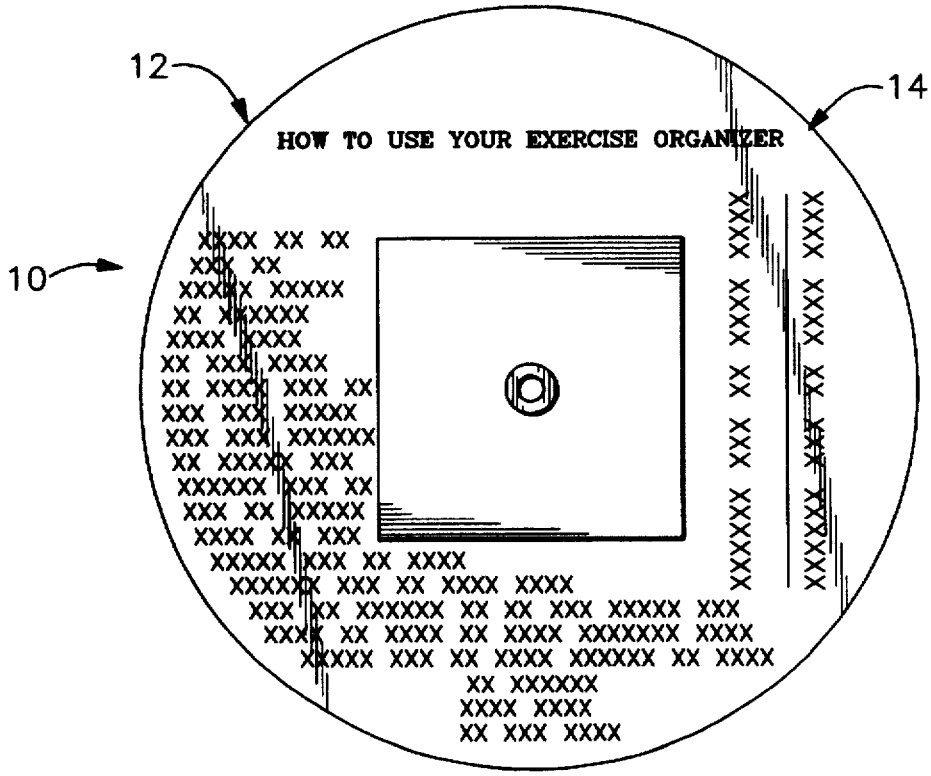
FIG. 5 is an elevational view of the reverse side of the base plate.

Instructions as to the use of the novel scheduler 10 may be written on the reverse side of base plate 12, as depicted in FIG. 5.

Significantly, the exercises may be written in pencil so that the order of exercises, or the number of repetitions, or the time duration of an exercise, or the like, may be changed to meet the needs of the exerciser. The changes may relate only to the information written on the outer circular line 22, or to both said line and radial lines 20, 21 as well.

Device 10 is not a preprinted, unchangeable scheduler; it provides, instead, a scheduler that may be changed easily by its user. Importantly, it is the only known device having the structural features disclosed herein and the only known device that performs the functions described herein.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A device for recording exercise regimens, comprising:

a base plate having a flat construction and a round configuration;

an intermediate plate having a flat construction and a round configuration;

a pointer plate having a flat construction and a generally round configuration;

said intermediate plate being disposed in sandwiched relation to said base plate and said pointer plate;

a pivot means that independently and rotatably connects said base plate, intermediate plate, and pointer plate in concentric relation to one another;

a plurality of radial lines disposed upon a first side of said base plate, said radial lines being circumferentially spaced apart from one another;

indicia means for identifying preselected groups of said radial lines, each radial line in a preselected group being contiguous to at least one other radial line in said preselected group;

a window means formed in said intermediate plate;

said window means being an opening formed in said intermediate plate, said opening being bordered by first and second radially disposed edges that define a predetermined angle therebetween so that a preselected group of said radial lines are exposed to view when said window means is in registration therewith;

said pointer plate including a pointer means that points at a preselected space between said radial lines when said pointer plate is rotated about said pivot means;

whereby an exerciser writes a series of exercises on said radial lines, one exercise per radial line, rotates said intermediate plate until said window means is aligned with a preselected group of radial lines, then rotates said pointer plate until said pointer means indicates a preselected exercise written on a preselected radial line adjacent a first edge of said edges defined by said window means, performs the exercise written thereon, indexes said pointer plate until said pointer means indicates a next exercise written on a contiguous radial line in said preselected group, performs an exercise written on said contiguous radial line, repeats said steps until said pointer means indicates a final exercise written on a radial line adjacent a second edge of said edges defined by said window means, rotates said intermediate plate so that said window means enters into registration with a second preselected grouping of radial lines, performs the exercises written thereon at a preselected time, and continuously repeats said steps for as long as an exercise program is followed by the exerciser.

2. The device of claim 1, wherein said base plate shares a common diameter with said intermediate plate.

3. The device of claim 2, wherein said pointer plate has a predetermined diameter less than said common diameter of said base and intermediate plates, said predetermined diameter of said pointer plate being sufficiently small to maintain exposure to view of all radial lines framed by said window means.

4. The device of claim 3, wherein said pointer means is a radially extending protrusion formed in said pointer plate.

5. The device of claim 1, further comprising a circular line disposed upon said base plate, radially inwardly of an outermost perimeter of said base plate, so that information may be written in a space defined by a contiguous pair of radial lines, a segment of said circular line, and said outermost perimeter of said base plate.

6. The device of claim 1, wherein said pivot means is a grommet.

7. The device of claim 1, further comprising a magnet means that abuts a second side of said base plate to facilitate releasable attachment of said device to a ferrous support surface.

8. The device of claim 5, further comprising a color-code for differentiating each group of radial lines from other groups of radial lines.

9. The device of claim 8, wherein said color-code is imprinted on said base plate along an outermost periphery thereof, radially outwardly of said circular line.

10. The device of claim 8, wherein radial lines at opposite ends of each group of radial lines are imprinted upon said base plate with lines that are thicker than that of the radial lines not at said opposite ends.

11. The device of claim 10, further comprising a plurality of pairs of oppositely-pointing arrows formed on said circular line for further differentiating said groups of radial lines from one another, said arrows abutting said thicker lines.

* * * * *